US006058522A

United States Patent [19]

Thakrar

[11] Patent Number: 6,058,522

[45] Date of Patent: May 9, 2000

[54] BATHTUB TRAY

[76] Inventor: Pratick Thakrar, 68 Kings Ave., Greenford Middlesex UB6 9DB, United Kingdom

[21] Appl. No.: 09/209,809

[22] Filed: Dec. 11, 1998

[51] Int. Cl.[7] ..... A47K 3/00

[52] U.S. Cl. ..... 4/559

[58] Field of Search ..... 4/559, 571.1, 573.1, 4/578.1, 579

[56] References Cited

U.S. PATENT DOCUMENTS 2,322,147 6/1943 Landauer ..... 4/579 X 3,239,850 3/1966 Kiss ..... 4/559

4,098,486 7/1978 Hornsby ..... 4/559 X 5,341,525 8/1994 Tillman et al. ..... 4/579

*Primary Examiner*—Robert M. Fetsuga

[57] ABSTRACT

A bathtub tray for resting on an upper edge of a bathtub to support items thereon above the bathtub. The bathtub tray includes a panel pivotally coupled to a spaced apart pair of planks. The arm portions of a generally U-shaped support bar are pivotally coupled to the planks to support a portion of the panel above the planks.

10 Claims, 2 Drawing Sheets

BATHTUB TRAY

BACKGROUND OF THE INVENTION

1. Related Application

This application is based on a previous patent application filed in Great Britain on Feb. 6, 1998 under serial number GB9802619.8 which is incorporated herein by reference.

2. Field of the Invention

The present invention relates to bathtub trays and more particularly pertains to a new bathtub tray for resting on an upper edge of a bathtub to support items thereon above the bathtub.

3. Description of the Prior Art

The use of bathtub trays is known in the prior art. More specifically, bathtub trays heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 3,950,793 by Adams; U.S. Pat. No. Des. 250,439 by Holstein; U.S. Pat. No. 4,525,882 by Stenberg; U.S. Pat. No. 4,953,473 by Tomaka et al.; U.S. Pat. No. 3,239,850 by Kiss; and U.S. Pat. No. 2,006,169 by Harris-Jones.

While these devices fulfill their respective, particular objectives and requirements, the aforementioned patents do not disclose a new bathtub tray. The inventive device includes a panel pivotally coupled to a spaced apart pair of planks. The arm portions of a generally U-shaped support bar are pivotally coupled to the planks to support a portion of the panel above the planks.

In these respects, the bathtub tray according to the present invention substantially departs from the conventional concepts and designs of the prior art, and in so doing provides an apparatus primarily developed for the purpose of resting on an upper edge of a bathtub to support items thereon above the bathtub.

SUMMARY OF THE INVENTION

In view of the foregoing disadvantages inherent in the known types of bathtub trays now present in the prior art, the present invention provides a new bathtub tray construction wherein the same can be utilized for resting on an upper edge of a bathtub to support items thereon above the bathtub.

The general purpose of the present invention, which will be described subsequently in greater detail, is to provide a new bathtub tray apparatus and method which has many of the advantages of the bathtub trays mentioned heretofore and many novel features that result in a new bathtub tray which is not anticipated, rendered obvious, suggested, or even implied by any of the prior art bathtub trays, either alone or in any combination thereof.

To attain this, the present invention generally comprises a panel pivotally coupled to a spaced apart pair of planks. The arm portions of a generally U-shaped support bar are pivotally coupled to the planks to support a portion of the panel above the planks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub tray apparatus and method which has many of the advantages of the bathtub trays mentioned heretofore and many novel features that result in a new bathtub tray which is not anticipated, rendered obvious, suggested, or even implied by any of the prior art bathtub trays, either alone or in any combination thereof.

It is another object of the present invention to provide a new bathtub tray which may be easily and efficiently manufactured and marketed.

It is a further object of the present invention to provide a new bathtub tray which is of a durable and reliable construction.

An even further object of the present invention is to provide a new bathtub tray which is susceptible of a low cost of manufacture with regard to both materials and labor, and which accordingly is then susceptible of low prices of sale to the consuming public, thereby making such bathtub tray economically available to the buying public.

Still yet another object of the present invention is to provide a new bathtub tray which provides in the apparatuses and methods of the prior art some of the advantages thereof, while simultaneously overcoming some of the disadvantages normally associated therewith.

Still another object of the present invention is to provide a new bathtub tray for resting on an upper edge of a bathtub to support items thereon above the bathtub.

Yet another object of the present invention is to provide a new bathtub tray which includes a panel pivotally coupled to a spaced apart pair of planks. The arm portions of a generally U-shaped support bar are pivotally coupled to the planks to support a portion of the panel above the planks.

Still yet another object of the present invention is to provide a new bathtub tray that may be used to rest reading materials such as books, newspapers, and magazines thereon for a user soaking in a bathtub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
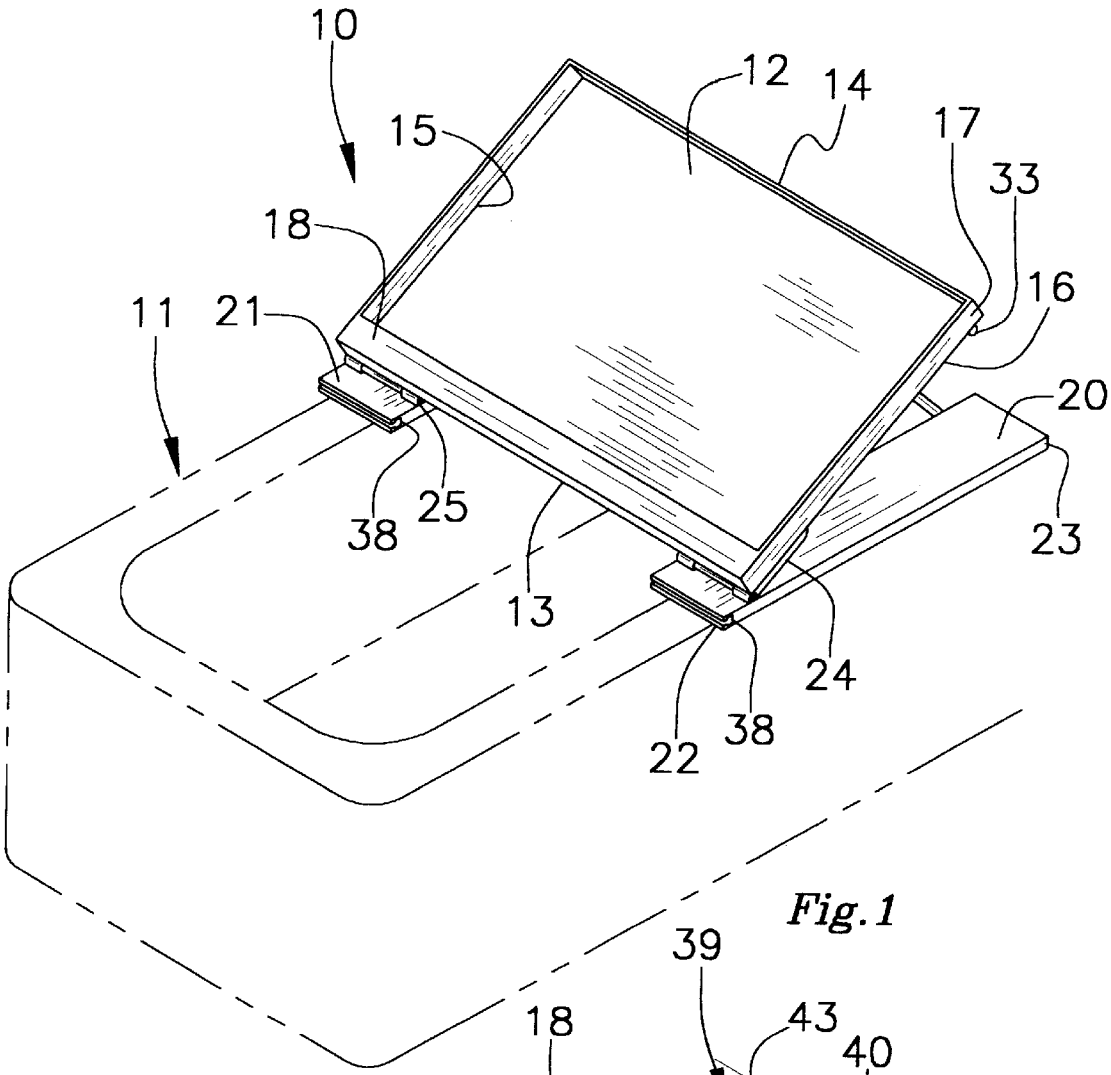
FIG. 1 is a schematic perspective view of a new bathtub tray in use on a bathtub according to the present invention.
Figure 2:
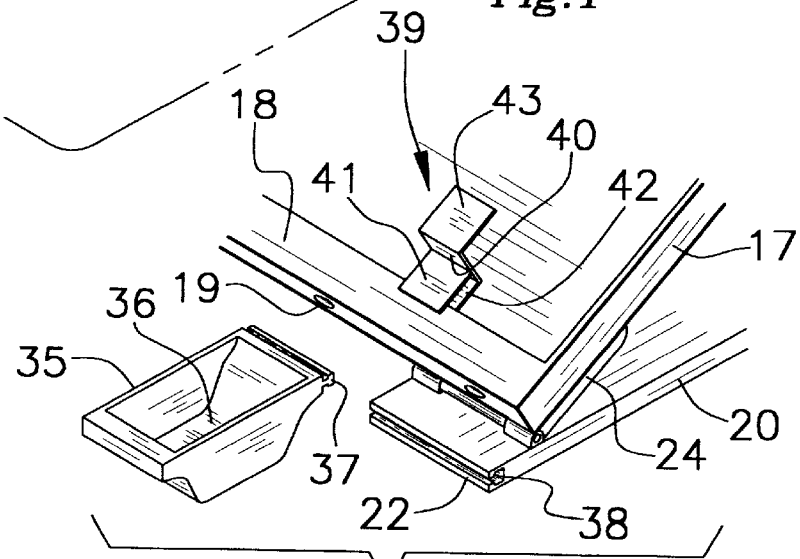
FIG. 2 is a schematic partial exploded perspective view of the present invention with a dish and book clip.
Figure 3:
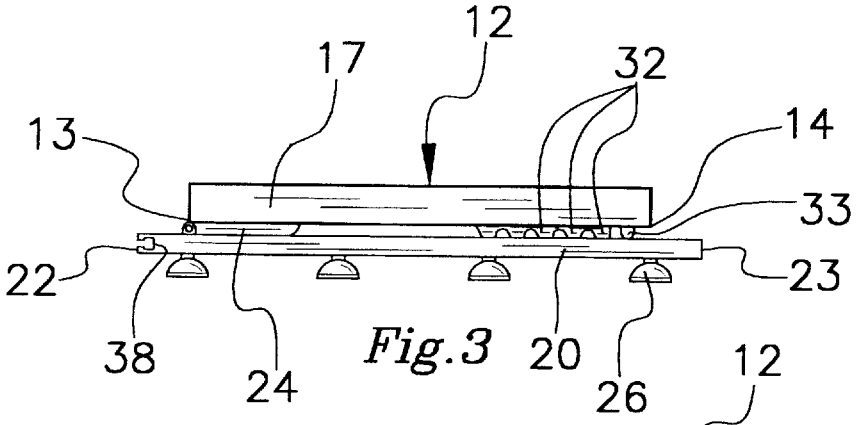
FIG. 3 is a schematic side view of the present invention with the panel pivoted to a horizontal position.

With reference now to the drawings, and in particular to FIGS. 1 through 6 thereof, a new bathtub tray embodying the principles and concepts of the present invention and generally designated by the reference numeral 10 will be described.

As best illustrated in FIGS. 1 through 6, the bathtub tray 10 generally comprises a panel pivotally coupled to a spaced apart pair of planks. The arm portions of a generally U-shaped support bar are pivotally coupled to the planks to support a portion of the panel above the planks.

In use, the tray 10 is designed use with a bathtub 11 having a perimeter wall with an upper edge, a pair of end walls and a pair of side walls extending between the end walls of the perimeter wall of the bathtub. In closer detail, the tray 10 comprises a generally rectangular panel having substantially planar generally rectangular upper and lower faces, and a generally rectangular outer perimeter comprising generally straight proximal and distal edges 13,14 and a pair of side edges 15,16 extending between the proximal and distal edges of the panel. The proximal and distal edges of the panel are preferably extended substantially parallel to one another and the side edges of the panel are preferably extended substantially parallel to one another and substantially perpendicular to the proximal and distal edges of sad panel.

Figure 5:
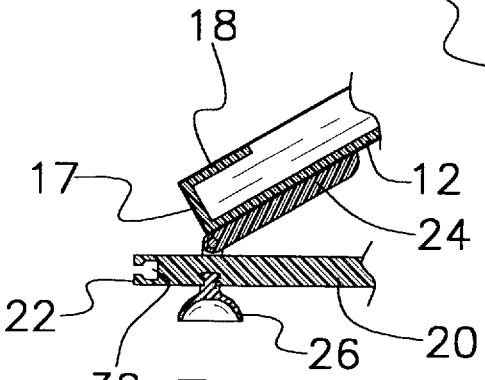
FIG. 5 is a schematic partial cross sectional view of the perimeter lip at the proximal edge of the panel.

The panel preferably has a perimeter lip 17 outwardly extending substantially perpendicularly from the upper face of the panel along the outer perimeter of the panel. The perimeter lip has an outer edge with a generally rectangular elongate strip 18 extending therealong across the proximal edge of the panel between the side edges of the panel. As illustrated in FIG. 5, the strip of the perimeter lip and the upper face of the panel are spaced apart and lie in substantially parallel planes to one another.

In use, the upper face of the panel is designed for resting items such as reading material thereon. The perimeter lip is designed for helping keep the items on the upper face of the panel. The strip of the perimeter lip is designed for holding the pages of books and other reading material open on the upper face of the panel.

The perimeter lip preferably has a plurality of generally circular drain holes 19 therethrough. The drain holes are positioned on a portion of the perimeter lip located adjacent the proximal edge of the panel. In use, the drain holes are designed for permitting any water that may be splashed on to the upper face of the panel to drain away off of the panel.

A spaced apart pair of generally rectangular planks 20,21 each have substantially planar top and bottom faces, and a pair of opposite ends 22,23 and a pair of substantially parallel sides extending between the ends of the respective plank. The sides of the planks are extended substantially parallel to one another.

The proximal edge of the panel is pivotally coupled to the top face of each of the planks adjacent a first of the ends 22 of each of the planks. Preferably a pair of hinges 24,25 pivotally couple the proximal edge of the panel to the planks. The proximal edge of the panel is extended substantially parallel to the first ends of the planks and substantially perpendicular to the sides of the planks. Preferably, an outer side of a first of the planks and one of the side edges of the panel lie in a generally vertical common plane with one another while an outer side of a second of the planks and the other side edge of the panel lie in a generally vertical common plane with one another.

In use, the bottom faces of the planks are designed for resting on an upper edge of a perimeter wall of a bathtub such that the panel extends between a pair of spaced apart side walls of the perimeter wall of the bathtub. Preferably, the planks each has plurality of spaced apart suction cups 26 coupled to the bottom face of the respective plank. In use, the suction cups are designed for suctionally coupling the bottom faces of the planks to the upper edge of the perimeter wall of the bathtub. Ideally, each plank has four suction cups coupled thereto, the suction cups of each plank is spaced apart at generally equal intervals between the ends of the respective plank.

Figure 6:
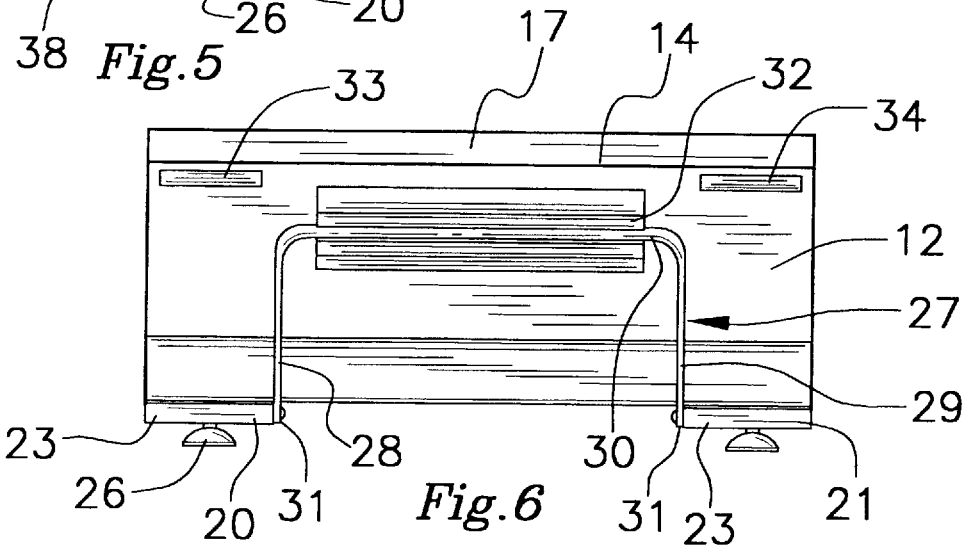
FIG. 6 is a schematic side view looking at the present invention from the distal edge of the perimeter side wall.

A generally rectangular U-shaped support bar 27 is provided having a spaced apart pair of elongate arm portions 28,29, and an elongate cross portion 30 connecting the arm portions of the support bar together. The arm portions of the support bar are preferably extended substantially parallel to one another and substantially perpendicular to the cross portion of the support bar. Each of the arm portions of the support bar has a free end 31 opposite the cross portion of the support bar. As best illustrated in FIG. 6, the free end of a first of the arm portions is pivotally coupled to an inner side of one of the planks while the free end of a second of the arm portions is pivotally coupled to an inner side of the other of the planks so that the cross portion of the support bar is extended between the planks substantially perpendicular to the sides of the planks.

Figure 4:
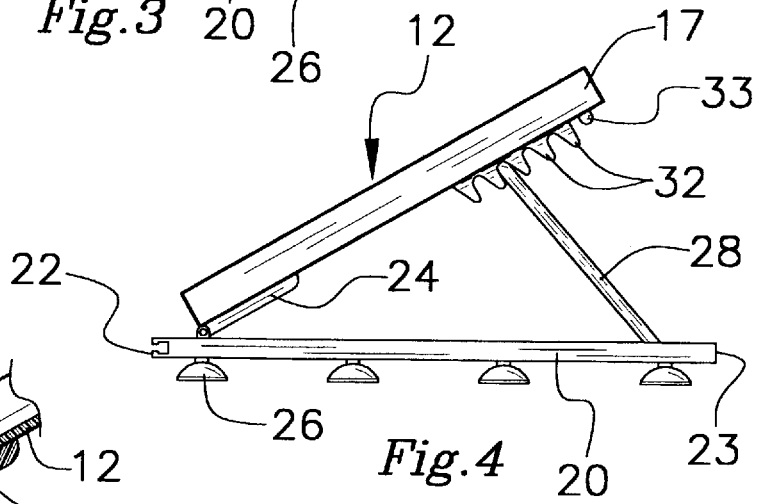
FIG. 4 is a schematic side view of the present invention with the panel to a raised position.

The lower face of the panel preferably has a row of spaced apart outwardly extending elongate ridges 32 adjacent the distal edge of the panel. The ridges are extended substantially parallel to the distal edge of the panel. The ridges of the panel define a plurality of elongate generally U-shaped channels therebetween. With reference to FIG. 4, the cross portion of the support bar is extended into one of the channels of the panel such that the distal edge of the panel is supported by the support bar above the planks. Ideally, the ridges of the panel comprise a resiliently deformable material for helping hold the cross portion in a groove between a pair of adjacent ridges.

Preferably, a pair of resiliently deformable bumpers 33,34 are coupled to the lower face of the panel adjacent the distal edge of the panel. One of the bumpers is positioned adjacent one of the side edges of the panel. The other of the bumpers is positioned adjacent the other of the side edges of the panel. In use, each of the bumpers is rested on the top face of the adjacent plank when the panel is pivoted to a generally horizontal orientation.

In the preferred embodiment, a dish 35 is detachably attached to the first end edge of one of the planks. The dish has a depression 36 therein designed for holding items therein such as for example: resting a cup therein, or holding a bar of soap therein or holding liquid bathing oils and soaps therein. Preferably, the dish has an elongate tongue 37 extending therefrom and the first end edges of the planks each have a groove 38 therein. The tongue of the dish is slidably inserted into the groove of one of the planks. The tongue and the grooves are of complementary cooperating transverse cross sections for preventing detachment of the dish from the one plank without relative sliding motion therebetween.

Also provided in the preferred embodiment is a book clip 39 for holding the pages of a book thicker than the distance between the strip and the upper face of the panel. The book clip comprises a middle portion 40 with a spaced apart pair of mounting fingers 41,42 outwardly extending therefrom in a first direction and a holding finger 43 outwardly extending therefrom in a second direction opposite the first direction. The strip of the perimeter lip is inserted between the mounting fingers of the book clip with the holding finger extending towards the distal edge of the panel. In use, the holding finger is designed for holding down the pages of a thicker book resting on the panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tray for resting on an upper edge of a bathtub, said tray comprising:

a panel having upper and lower faces, and an outer perimeter comprising proximal and distal edges and a pair of side edges extending between said proximal and distal edges of said panel;

a spaced apart pair of planks each having top and bottom faces, and a pair of opposite ends and a pair of sides extending between said ends of the respective plank;

said proximal edge of said panel being pivotally coupled to said top face of each of said planks;

a generally U-shaped support bar having a spaced apart pair of elongate arm portions, and an elongate cross portion connecting said arm portions of said support bar together; and a first of said arm portions being pivotally coupled to one of said planks, a second of said arm portions being pivotally coupled to the other of said planks.

2. The tray of claim 1, wherein said panel has a perimeter lip outwardly extending substantially perpendicularly from said upper face of said panel along said outer perimeter of said panel.

3. The tray of claim 2, wherein said perimeter lip has an outer edge, said outer edge of said perimeter lip having a generally rectangular elongate strip extending therealong across said proximal edge of said panel between said side edges of said panel.

4. The tray of claim 2, wherein said perimeter lip having a plurality of generally circular drain holes therethrough, said holes being positioned on a portion of said perimeter lip located adjacent said proximal edge of said panel.

5. The tray of claim 1, wherein said planks each have plurality of spaced apart suction cups coupled to said bottom face of the respective plank.

6. The tray of claim 1, wherein said lower face of said panel has a row of spaced apart outwardly extending elongate ridges adjacent said distal edge of said panel, said ridges being extended substantially parallel to said distal edge of said panel, said ridges of said panel defining a plurality of elongate channels therebetween, said cross portion of said support bar being extended into one of said channels of said panel such that said distal edge of said panel is supported by said support bar above said planks.

7. The tray of claim 1, further comprising a pair of resiliently deformable bumpers being coupled to said lower face of said panel adjacent said distal edge of said panel, one of said bumpers being positioned adjacent one of said side edges of said panel, the other of said bumpers being positioned adjacent the other of said side edges of said panel.

8. The tray of claim 1, further comprising a dish being detachably attached to said first end edge of one of said planks, said dish having a depression therein.

9. The tray of claim 8, wherein said dish has an elongate tongue extending therefrom, said first end edges of said planks each have a groove therein, said tongue of said dish being slidably inserted into said groove of one of said planks, and wherein said tongue and said grooves are of complementary cooperating transverse cross sections for preventing detachment of said dish from said one plank without relative sliding motion therebetween.

10. A tray system for resting on an upper edge of a bathtub, said tray system comprising:

a bathtub having a perimeter wall, the perimeter wall of the bathtub having an upper edge, a pair of end walls and a pair of side walls extending between the end walls of the perimeter wall of the bathtub;

a generally rectangular panel having substantially planar generally rectangular upper and lower faces, and a generally rectangular outer perimeter comprising generally straight proximal and distal edges and a pair of side edges extending between said proximal and distal edges of said panel;

said proximal and distal edges of said panel being extended substantially parallel to one another, said side edges of said panel being extended substantially parallel to one another and substantially perpendicular to said proximal and distal edges of sad panel;

said panel having a perimeter lip outwardly extending substantially perpendicularly from said upper face of said panel along said outer perimeter of said panel;

said perimeter lip having an outer edge, said outer edge of said perimeter lip having a generally rectangular elongate strip extending therealong across said proximal edge of said panel between said side edges of said panel;

said strip of said perimeter lip and said upper face of said panel being spaced apart and lying in substantially parallel planes to one another;

said perimeter lip having a plurality of generally circular drain holes therethrough, said holes being positioned on a portion of said perimeter lip located adjacent said proximal edge of said panel;

a spaced apart pair of generally rectangular planks each having substantially planar top and bottom faces, and a pair of opposite ends and a pair of substantially parallel sides extending between said ends of the respective plank;

said planks being extended substantially parallel to one another;

said proximal edge of said panel being pivotally coupled to said top face of each of said planks adjacent a first of said ends of each of said planks;

said proximal edge of said panel being extended substantially parallel to said first ends of said planks and substantially perpendicular to said sides of said planks;

an outer side of a first of said planks and one of said side edges of said panel lying in a generally vertical common plane with one another, an outer side of a second of said planks and the other side edge of said panel lying in a generally vertical common plane with one another;

said bottom faces of said planks being rested on the upper edge of the side walls of the perimeter wall of a bathtub such that said panel extends between the side walls of the perimeter wall of the bathtub;

said planks each having plurality of spaced apart suction cups coupled to said bottom face of the respective plank, said suction cups suctionally coupling said bottom faces of said planks to the upper edge of the perimeter wall of the bathtub;

wherein each plank has four suction cups coupled thereto, said suction cups of each plank being spaced apart at generally equal intervals between said ends of the respective plank;

a generally U-shaped support bar having a spaced apart pair of elongate arm portions, and an elongate cross portion connecting said arm portions of said support bar together;

said arm portions of said support bar being extended substantially parallel to one another and substantially perpendicular to said cross portion of said support bar;

each of said arm portions of said support bar having a free end opposite said cross portion of said support bar, said free end of a first of said arm portions being pivotally coupled to an inner side of one of said planks, said free end of a second of said arm portions being pivotally coupled to an inner side of the other of said planks;

said cross portion of said support bar being extended between said planks substantially perpendicular to said sides of said planks;

said lower face of said panel having a row of spaced apart outwardly extending elongate ridges adjacent said distal edge of said panel, said ridges being extended substantially parallel to said distal edge of said panel;

said ridges of said panel defining a plurality of elongate channels therebetween;

said cross portion of said support bar being extended into one of said channels of said panel such that said distal edge of said panel is supported by said support bar above said planks;

a pair of resiliently deformable bumpers being coupled to said lower face of said panel adjacent said distal edge of said panel, one of said bumpers being positioned adjacent one of said side edges of said panel, the other of said bumpers being positioned adjacent the other of said side edges of said panel;

a dish being detachably attached to said first end edge of one of said planks, said dish having a depression therein;

said dish having an elongate tongue extending therefrom;

said first end edges of said planks each having a groove therein, said tongue of said dish being slidably inserted into said groove of one of said planks;

said tongue and said grooves being of complementary cooperating transverse cross sections for preventing detachment of said dish from said one plank without relative sliding motion therebetween;

a book clip comprising a middle portion having a spaced apart pair of mounting fingers outwardly extending therefrom in a first direction and a holding finger outwardly extending therefrom in a second direction opposite said first direction; and said strip of said perimeter lip being inserted between said mounting fingers of said book clip, said holding finger being extended towards said distal edge of said panel.

* * * * *